US006200187B1

(12) United States Patent
Olsen et al.

(10) Patent No.: US 6,200,187 B1
(45) Date of Patent: Mar. 13, 2001

(54) CONSTRUCTION BUILDING SET

(75) Inventors: Flemming Højberg Olsen, Espergærde; Per Brømsø, Copenhagen S, both of (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/029,551

(22) PCT Filed: Sep. 13, 1996

(86) PCT No.: PCT/DK96/00389

§ 371 Date: Mar. 6, 1998

§ 102(e) Date: Mar. 6, 1998

(87) PCT Pub. No.: WO97/10036

PCT Pub. Date: Mar. 20, 1997

(30) Foreign Application Priority Data

Sep. 14, 1995 (DK) ..... 1020/95

(51) Int. Cl.[7] ..... A63H 33/12

(52) U.S. Cl. ..... 446/122; 446/120; 446/124; 446/128

(58) Field of Search ..... 446/128, 124, 446/125, 126, 127, 122; 52/284, 592.3

(56) References Cited

U.S. PATENT DOCUMENTS 1,009,469 * 11/1911 Burrowes ..... 446/128
3,005,282 * 10/1961 Christiansen ..... 446/128
3,034,254 * 5/1962 Christiansen ..... 446/128
3,481,068 * 12/1969 Paulson ..... 446/128
3,597,875 8/1971 Christiansen .
5,061,218 * 10/1991 Garage et al. ..... 446/128

FOREIGN PATENT DOCUMENTS

367719A * 5/1990 (EP) ..... 446/128
630302 * 10/1949 (GB) ..... 446/128
9308886 5/1993 (WO) .

* cited by examiner

*Primary Examiner*—Kien T. Nguyen
*Assistant Examiner*—Bena B. Miller
(74) *Attorney, Agent, or Firm*—Pitney, Hardin, Kipp & Szuch LLP

(57) ABSTRACT

A toy construction building set includes first and second building elements, which are releaseably interconnectable. The first building elements have a side with a coupling surface, which has coupling studs, and the second building elements have a side with a coupling surface, which has a skirt. Defined within the skirt is a cavity for receiving the coupling studs on the first building element. When the first and second building elements are interconnected, a first abutment portion of the first building element is outside the skirt and a second abutment portion of the second building element abuts the first abutment portion.

6 Claims, 3 Drawing Sheets

CONSTRUCTION BUILDING SET

The present invention relates to a construction building set with building elements having the constructive features described herein.

Today, construction building sets of this type are widely known and available, and examples thereof include the Applicant's own construction building sets marketed i.a. under the trade mark DUPLO®. This construction building set is disclosed in U.S. Pat. No. 3,597,875.

It is the object of the present invention to provide a construction building set whereby it is possible to build constructions wherein the couplings between said building elements are capable of resisting substantial impacts from external influences, by means of building elements having coupling means known per se.

This object is achieved with the invention since the building elements of the construction building set include building elements having a structure as specified in the claims. If a building element, e.g. in the form of an aeroplane wing, is looked upon as a lever, the fulcrum of the aeroplane wing will move away from a primary coupling area formed by the coupling skirt and the studs. The location of the fulcrum will be determined by a secondary coupling area in the form of the cooperating abutment portions. It is the only object of the cooperating abutment portions to serve as the fulcrum with a view to reducing the ratio between the lever arms, thereby reducing the separation force between the two building elements.

The cooperating abutment portion on the building element of the first type constitutes an abutment surface without coupling studs, since the coupling studs in the primary coupling area will be able to provide adequate coupling.

In practice, the preferred embodiment will be an injection-moulded plastics element and the top surface will be a plane surface with coupling studs whereas the underside, which is open since the core was withdrawn in connection with the casting operation, will have protruding columns, walls or the like to form the a butment portions of the element.

The plane coupling surface with coupling studs will preferably merge with the plane abutment surface via a straight dividing line, the coupling surface and the abutment surface together forming an obtuse angle. in a preferred embodiment, the building element of the second type will have a rectangular coupling surface and two abutment surfaces which are adjacent to each their respective one of two opposite sides of the rectangular coupling surface, and the coupling surface and the two abutment surfaces in combination will form a convex surface on a portion of the building element. This construction is particularly suitable for aeroplane wings since the same element may be used for both the left and the right wings and the coupling is able to resist torsion, bending or flexing of the wing, depending on the respective designs of the primary and the secondary coupling surfaces.

If, in addition to coupling studs and complementary coupling means, the building elements are provided with an integral screw whereby a strong coupling between the two elements may be established, an impact between the elements will cause a pulling force to be exerted on the screw. In case the elements are provided with secondary coupling areas as described above, the magnitude of the force exerted on the screw will be reduced whereby the threaded portions of the elements will not suffer any damage, even in case of powerful influences.

A convex surface is formed on the element of the first type and the obtuse angle will normally be comprised within the range of 120–170°, i.e. the inclined abutment surface will form an angle relative to the imaginary extension of the coupling surface of 10–60°.

Preferred embodiments of the invention will now be described in further detail with reference to the drawings, wherein.

Figure 1:
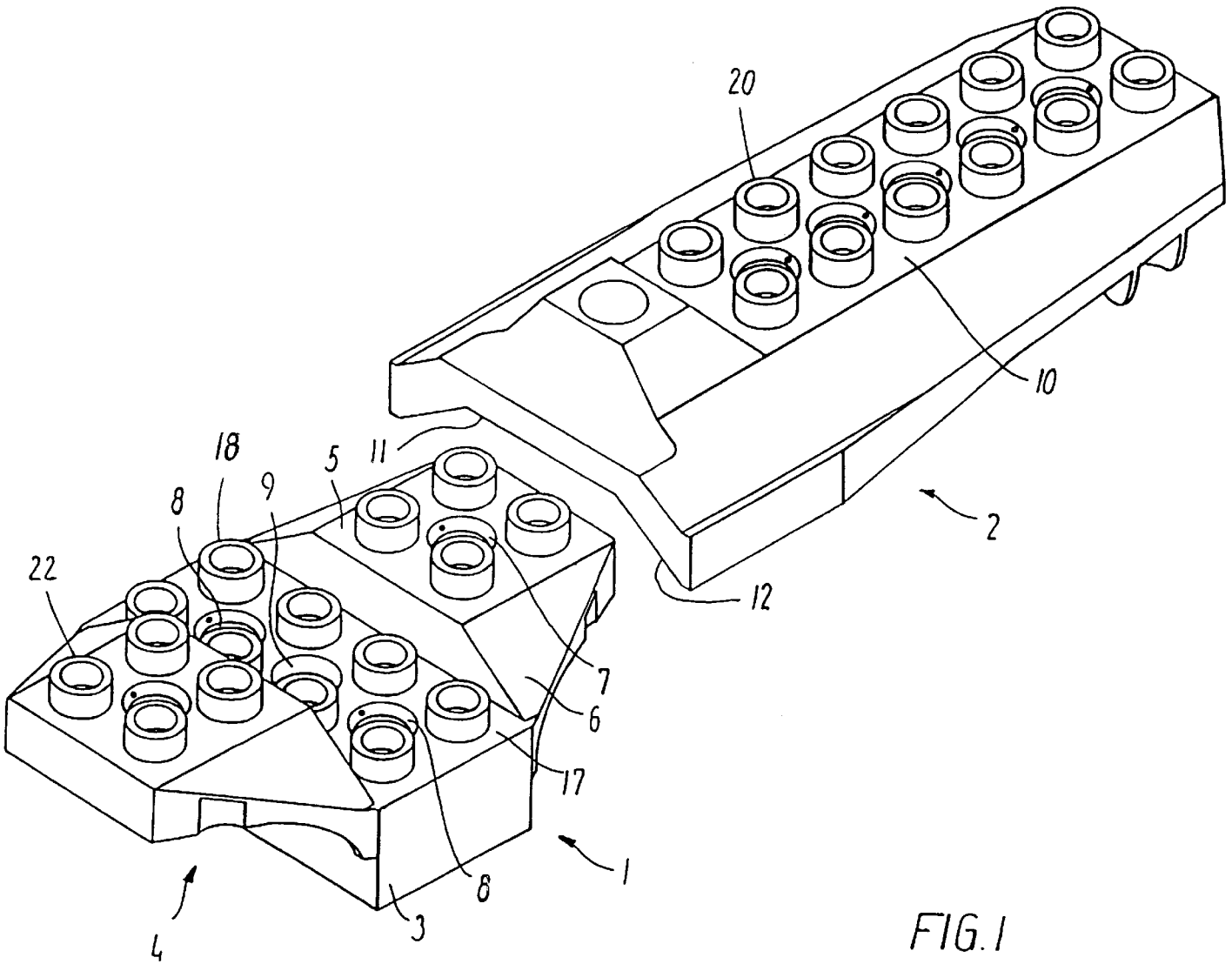
FIG. 1 is a schematic and perspective view of a preferred embodiment of two separate building elements for a construction building set according to the invention.
Figure 2:
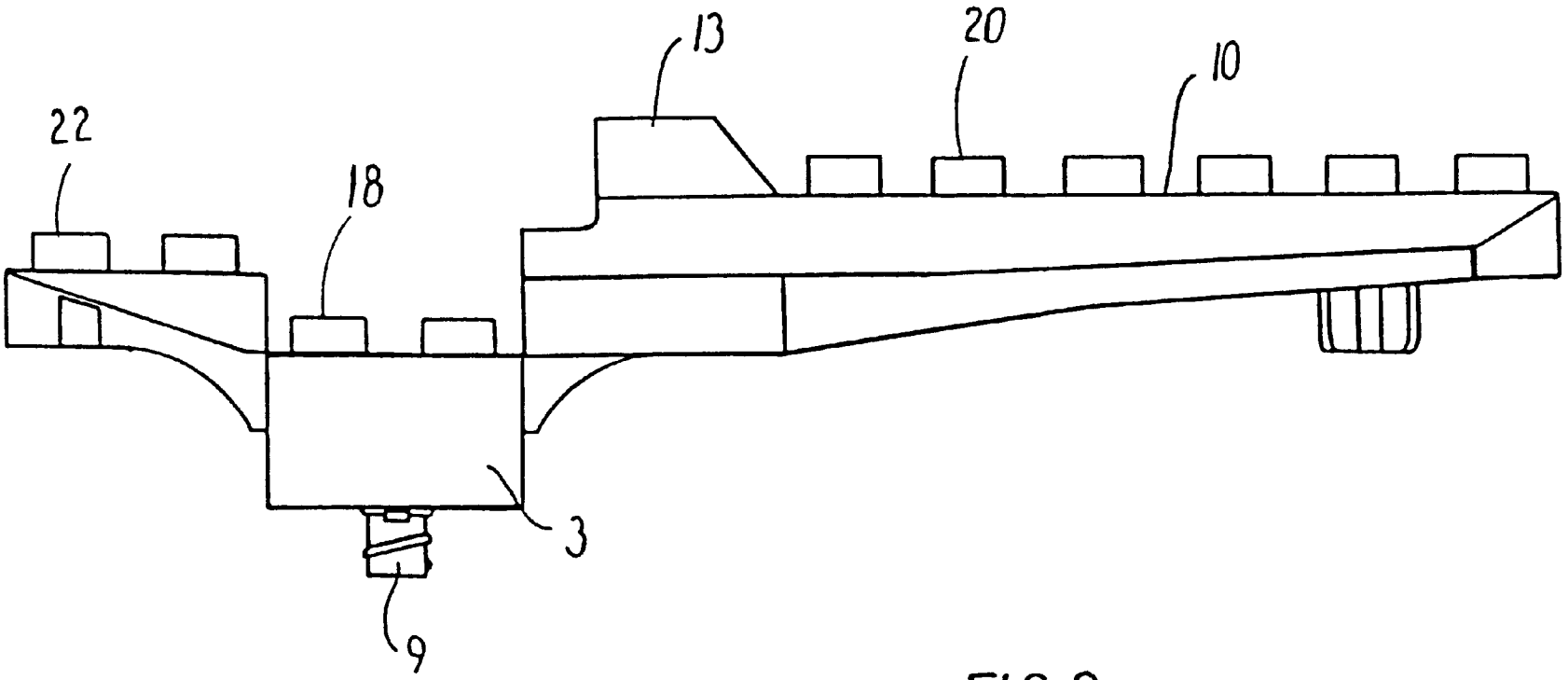
FIG. 2 is a sideview of the building elements illustrated in FIG. 1 in their assembled state.

FIGS. 1 and 2 illustrate two building elements 1 and 2 in their separated and assembled states, respectively. The first element 1 has a box-shaped body 3 corresponding to building elements of the construction building set marketed by the Applicant under the trade mark DUPLO®. On the top surface of the body 3, a surface 17 with coupling studs 18 is provided, while the underside comprises an annular coupling skirt and downwardly protruding tubular members which cooperate with the skirt to establish three-point couplings with the coupling studs on a another building element by interconnecting.

The building element 1 has three tubular members in its body and in the two outermost tubular members threaded openings 8 are provided to receive screws from another building element whereas the central tubular member is provided with a displaceable screw 9 as seen in FIG. 2. Screws of this type are known from the present Applicant's European patent application No. EP-A-612 262.

Along the upper longitudinal sides of the body, the building element 1 is provided with two protruding carrier portions 4 for mounting of the building elements 2 which serve as aeroplane wings. The carrier portions 4 each have a coupling surface 5 with four coupling studs 22. Moreover, each carrier portion 4 has two abutment surfaces 6 which are inclined relative to the coupling surface 5. Centrally in the coupling surfaces 5 a threaded hole 7 is provided.

Figure 3:
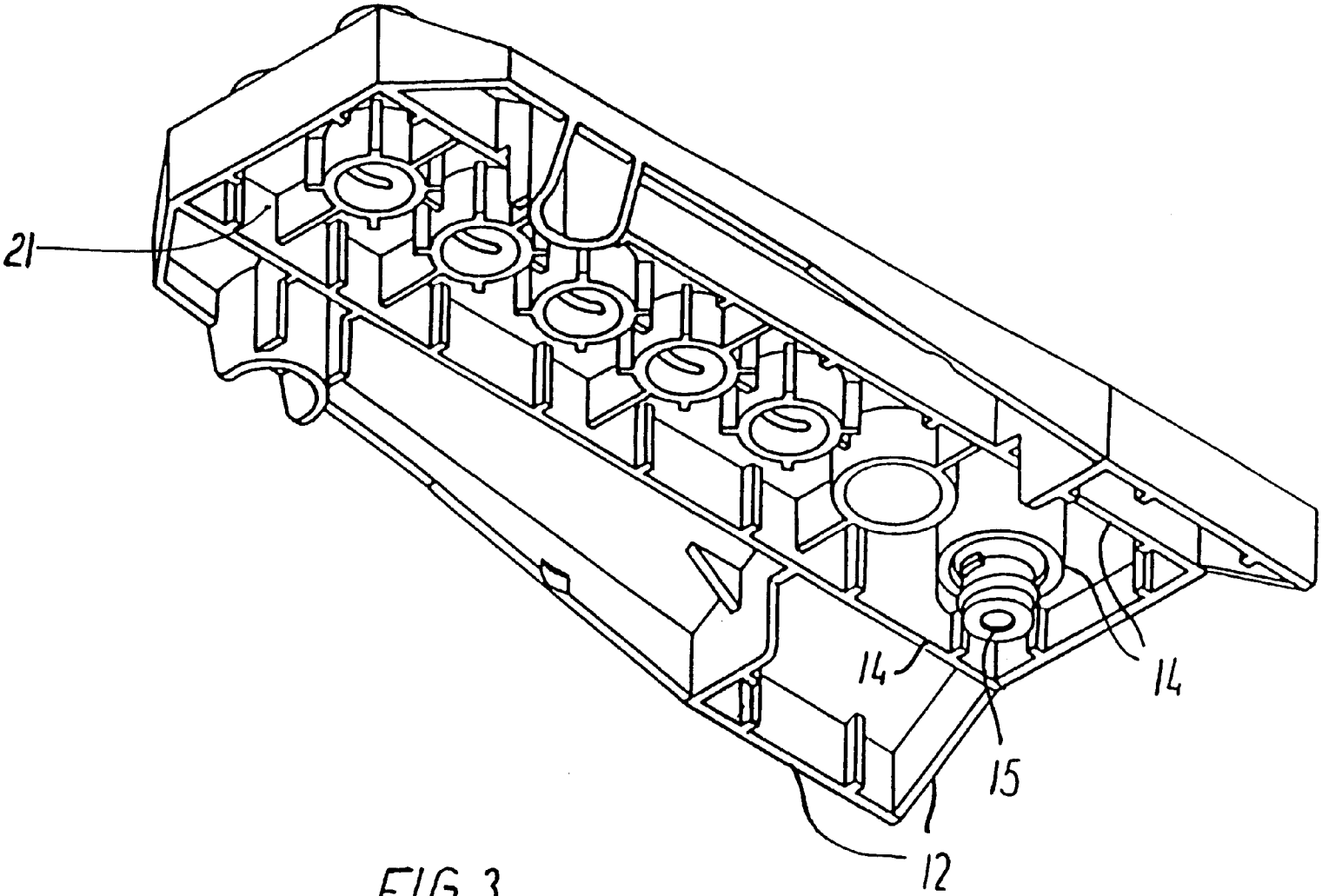
FIG. 3 is a perspective bottom view of the building elements described in FIGS. 1 and 2.

The wing element 2 is also provided with a coupling surface 10 with coupling studs 20 on the top surface and corresponding complementary coupling means 21 on the underside, as will appear from FIG. 3. The primary coupling surface on the wing element for coupling with the element 1 is designated by the reference numeral 11, and in this case the edges 14 constitute the coupling skirts.

The cooperating abutment surfaces which cooperate through abutment outside the coupling skirt 14 upon interconnecting of the two building elements 1 and 2, consist of wall portions 12 which, following interconnecting of the building elements, rest on the inclined abutment surfaces 6 of the second element.

Hereby the force influencing the frictional coupling provided by the coupling studs and their complementary coupling means is reduced, thereby allowing the frictional coupling to tolerate more powerful impact acting upon the arm without ensuing separation.

This is extremely important when the screw 15 has been screwed home in the hole 7 since the pulling force acting on the screw is reduced whereby the stress imposed on the threaded portions of the screw is reduced.

What is claimed is:

1. A toy construction building set comprising:

a first building element having a coupling surface with coupling studs on said coupling surface and a threaded hole; and a second building element having a skirt defining, within said skirt, a cavity for receiving said coupling studs on said first building element and coupling means within said cavity for engaging said coupling studs in a releasable interconnection of said first and second building elements and a screw within said skirt; said screw being screwable into the threaded hole when said first and second building elements are interconnected;

wherein said first building element has a first abutment portion which, when said first and second elements are interconnected, is outside said skirt; and wherein said second building element has a second abutment portion which is outside said skirt and defines a space between said second abutment portion and said skirt, and which, when said first and second elements are interconnected, abuts said first abutment portion with no coupling studs and no coupling means being present in said space.

2. The toy construction building set according to claim 1, wherein the first abutment portion is shifted relative to the coupling surface having coupling studs, and said second abutment portion is situated at a distance from said skirt and from an imaginary extension thereof.

3. The toy construction building set according to claim 1 wherein the first abutment portion forms an abutment surface without coupling studs.

4. The toy construction building set according to claim 3, wherein the second abutment portion is in the form of protrusions having tips abutting the first abutment portion when said first and second building elements are interconnected.

5. The toy construction building set according to claim 4, wherein the abutment surface on the first building element is substantially planar, and that the coupling surface with coupling studs and the planar abutment surface merge via a straight dividing line, the coupling surface and the abutment surface together forming an obtuse angle.

6. The toy construction building set according to claim 5, wherein the first building element has a rectangular coupling surface and two abutment surfaces which are adjacent to each of their respective one of two opposite sides of the rectangular coupling surface, and the coupling surface and the two abutment surfaces together form a convex surface on a portion of the first building element.

* * * * *